United States Patent [19]

Moser

[11] 4,428,304

[45] Jan. 31, 1984

[54] ADJUSTABLE SHELF UNIT

[75] Inventor: Robert Moser, Eureka, Ill.

[73] Assignee: Parsons Manufacturing, Incorporated, Roanoke, Ill.

[21] Appl. No.: 273,682

[22] Filed: Jun. 15, 1981

[51] Int. Cl.[3] ..... A47B 1/00

[52] U.S. Cl. ..... 108/65; 49/127; 108/133; 108/147; 211/135; 312/297; 312/331

[58] Field of Search ..... 108/102, 65, 45, 143, 108/137; 49/127; 312/297, 331; 211/135, 151, 153

[56] References Cited

U.S. PATENT DOCUMENTS

| | | | |
|---|---|---|---|
| 2,517,284 | 8/1950 | Calvert | 211/153 |
| 3,221,677 | 12/1965 | Kerr | 108/102 |
| 3,334,954 | 8/1967 | Kesling | 211/153 X |
| 3,722,964 | 3/1973 | Chitester et al. | 312/331 X |
| 3,811,223 | 5/1974 | Ito | 49/127 |
| 3,896,742 | 7/1975 | Ferraro | 312/297 |
| 4,155,312 | 5/1979 | Thorkildson | 211/153 X |
| 4,227,466 | 10/1980 | Rooklyn | 211/151 |

*Primary Examiner*—James T. McCall

*Attorney, Agent, or Firm*—Wood, Dalton, Phillips, Mason & Rowe

[57] ABSTRACT

An adjustable shelf unit for use in a storage rack and having at least two shelf panels supported on laterally spaced forwardly extending support members. Each panel is slidable over the panel behind it and each panel but the front panel has a indentation across its forward edge the depth of which is equal to the thickness of a transversely extending lip on the rear of the panel in front of it. The side flanges of the panels have tabs which engage one another when the panels are extended to limit the forward travel of the panels. Also disclosed is a cable which is looped around sheaves fixed to the support members. The cable is fixed to each side of the front panel so as to maintain proper alignment of the panels.

14 Claims, 5 Drawing Figures

FIG. 1
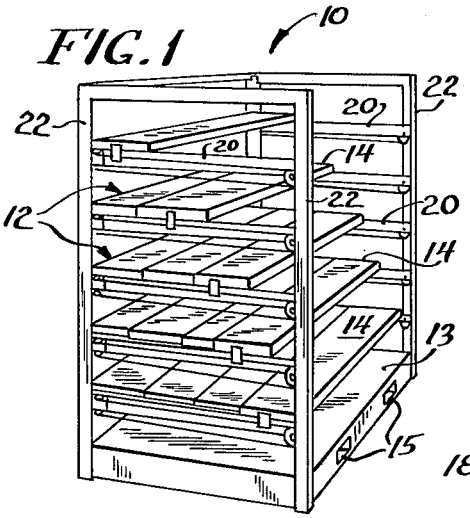
FIG. 2
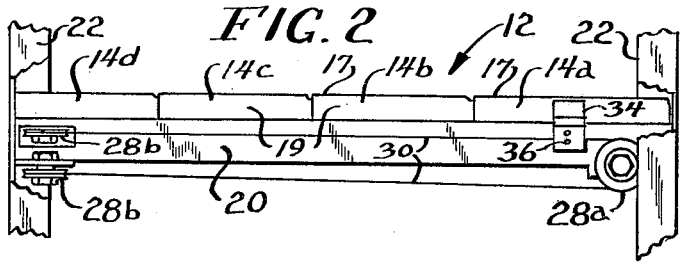
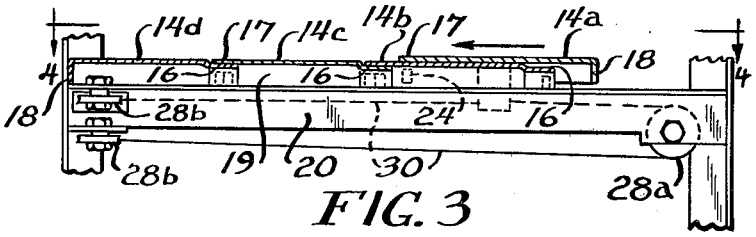
FIG. 3
FIG. 4
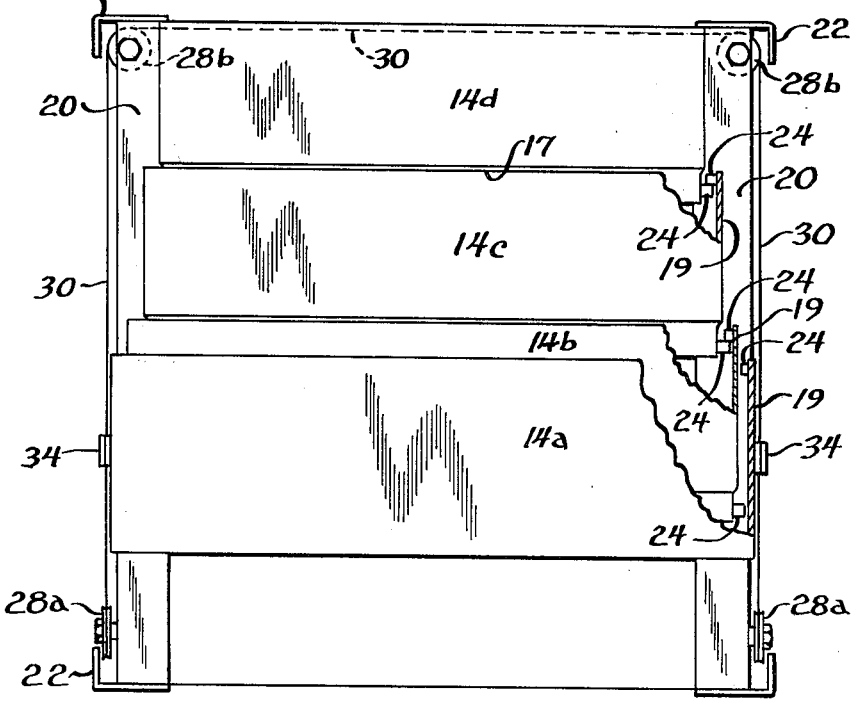
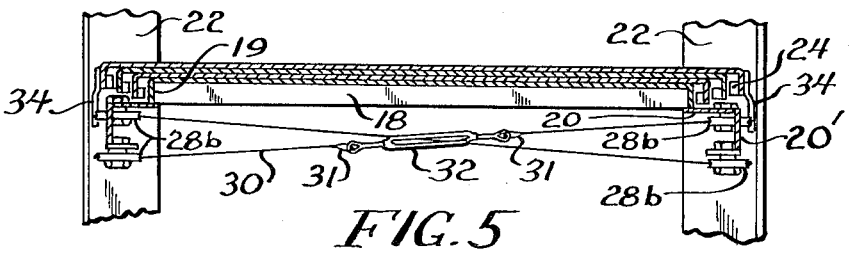
FIG. 5

ADJUSTABLE SHELF UNIT

BACKGROUND ART

1. Field of the Invention

This invention relates to a shelf unit for use in a storage rack and more particularly to a shelf unit which may be adjusted to provide a variable shelf depth.

2. Prior Art

Shelf extensions have heretofore been used to provide extra space in some storage racks. However, such extensions are merely additions to a conventional shelf and thus do not permit reduction of the shelf depth beyond the depth of the storage rack itself. Further, the extensions must be completely removed from a shelf when the additional depth is not required, and thus the extensions require storage space themselves when not in use.

Adjustable depth shelves are desirable to enable tall items to be stored on a lower shelf without necessitating the removal of an entire overlying shelf. Such shelves have been used in refrigerators. However, since refrigerator shelves are formed from horizontal bars, those shelves have not been readily adaptable for use when a flat supporting surface is required.

It is desirable to have a shelf unit which may be adjusted by telescoping shelf panels to present a desired shelf depth, thereby enabling quick adjustments to shelf depth when desired and eliminating the need for storage of unused panels. However, use of telescoping shelf panels in the past has been undesirable since overlapping areas between panels have had ridges on which stored items catch when pulled over the shelf surface. Further, since such shelf panels are generally substantially wider than they are deep, there is a great tendency for the telescoping panels to twist relative to one another, thereby binding and becoming inoperative.

SUMMARY OF THE INVENTION

This invention is directed to overcoming one or more of the problems as set forth above.

An adjustable shelf unit is disclosed for use in a storage rack. The unit consists of at least two shelf panels supported on laterally spaced support members. The front shelf panel is slidable over the rear shelf panel and the rear shelf panel has an indentation across its front edge equal to the thickness of a lip extending transversely across the rear of the front shelf panel. When the front panel is fully extended, its rear lip rests in the indentation of the rear panel, thereby presenting a smooth supporting surface between the two panels. For maximum adjustability of shelf depth, intermediate shelf panels, each having a rear lip and an indentation across the front edge, may also be used.

Tabs on the side flanges of the shelf panels engage one another to prevent pulling apart of the panels during extension of the shelf unit.

A cable and sheave arrangement maintains proper alignment of the panels, which prevent binding when the panels are being extended or pushed backward. The cable is looped around six sheaves fixed to the support members and extends between and along both sides of the support members. The loop portion between the support members is preferably crossed. Both ends of the front panel are secured to the cable so that motion of one end of the front panel causes the cable to move the other end the same distance. This ensures that the front panel remains properly aligned with the support members at all times and thereby prevents binding between panels when the shelf is adjusted.

Other aspects, objects and advantages of the invention will be apparent to those skilled in the art from the following detailed description, taken in conjunction with the drawings and the appended claims.

BRIEF DESCRIPTION OF THE DRAWINGS

FIG. 1 is a perspective view of a storage rack comprising five of the shelf units of the invention adjusted to various depths;

FIG. 2 is a partially broken side view of a shelf unit of the rack of FIG. 1;

FIG. 3 is a cross-sectional side view of a shelf unit;

FIG. 4 is a partially broken top view of the shelf unit of FIG. 3 taken along line 4—4 wherein the size of the tabs and the difference in lengths of the panels are exaggerated; and FIG. 5 is a front cross-sectional view of a shelf unit in its minimum depth position.

DESCRIPTION OF THE PREFERRED EMBODIMENT

A storage rack 10 comprising five adjustable shelf units 12 and a conentional shelf 13 is shown in FIG. 1. Each shelf unit 12 comprises a plurality of panels 14, described below, and is adjustable to various depths as shown to permit storage of items which are taller than the vertical distance between adjacent shelf units 12. Although five shelf units 12 are shown in FIG. 1, each unit 12 is separate from the others and a rack 10 may be assembled using any number of the adjustable shelf units 12 optimally in combination with one or more conventional shelves, such as the shelf 13. The rack 10 may also be provided with openings 15 for forklift tongues to permit ready movement of the entire rack 10.

FIG. 2 is a side view of a fully extended shelf unit 12. Four shelf panels 14 are shown, although a unit 12 may be constructed with any number of panels greater than one. The shelf panels 14 include a front panel 14*a*, first and second intermediate panels 14*b*, 14*c* and a rear panel 14*d*.

Each of the intermediate panels 14*b*, 14*c* and the rear panel 14*d* have an indentation 16 across its respective forward edge (best seen in FIG. 3). The indentations 16 are approximately the thickness of one panel 14 so that, when the panels 14 are extended, a transversely extending rear lip 17 of one panel 14 will rest in the indentation 16 of the panel 14 behind it, thereby presenting a flat supporting surface.

The forward and rear panels 14*a*, 14*d* have lateral flanges 18 (best seen in FIG. 3) to provide added lateral strength to the shelf unit 12. The intermediate panels 14*b*, 14*c* need not have such flanges since additional strength is provided by the overlapping portions of the panels 14. All of the panels 14 have end flanges 19.

The shelf panels 14 are supported on both ends by forwardly extending frame members 20 each of which has a downwardly extending flange portion 20' (FIG. 5) for strength. The frame members 20 are fixed to the vertical supports 22 of the storage rack 10 by suitable means (not shown). It is preferred that a nut and bolt mounting or the like be used to permit the shelf unit 12 to be removed entirely when desired.

FIGS. 3 and 4 show a shelf unit 12 which has been partially pushed back from a fully extended position. When the front panel 14*a* is pushed back, its rear lip 17 rides up over the first intermediate panel 14b, effectively telescoping over the panel 14b. The rear of the indentation 16 is rounded to facilitate such telescoping. Continued pushing on the front panel 14a results in telecoping of the remaining panels 14b, 14c, 14d until the unit 12 has an effective depth equivalent to only one panel.

From the minimum depth (i.e. one panel) position, exhibited by the uppermost unit 12 in FIG. 1, the unit 12 may be extended to any desired intermediate depth. It is preferred that the depth of the shelf unit 12 be adjusted by pulling the panels 14 out rather than pushing them in from an extended position. Although a desired shelf depth may be obtained by pushing the panels 14 in, the rear lip 17 of the forward telescoped panels 14 would not rest in the indentation 16 of the adjacent panel 14. This can clearly be seen in FIG. 3. Although adjustment of the shelf unit 12 by pulling out the panels 14 results in a slight forward tilt to the panel 14b or 14a adjacent the panel 14c or panels 14c, 14b telescoped over the rear panel 14d, the tilt is minimal since the thickness to depth ratio of the panels 14 is very small.

Tabs 24 extend from the ends of the shelf panels 14 as is best seen in FIG. 4. The size of the tabs 24 has been exaggerated in FIG. 4 to better illustrate their operation, resulting in an exaggeration of the differences in length between the shelf panels 14 as well. Tabs 24 are located on the outer sides of the end flanges 19 of all but the front panel 14a. Tabs 24 are also located on the inner sides of the end flanges 19 of all but the rear panel 14d.

The tabs 24 cause sucessive shelf panels 14 to be extended when the front panel 14a is pulled out. The front panel 14a slides over the first intermediate panel 14b until the tabs 24 on the inner sides of the flanges 19 of the front panel 14a engage the tabs 24 on the outer sides of the flanges 19 of the first intermediate panel 14b. At that point, the rear lip 17 of the front panel 14a rests in the indentation 16 at the front edge of the first intermediate panel 14b. The shelf unit 12 may then be used with this intermediate depth.

Pulling the front panel 14a further pulls the first intermediate panel 14b over the second intermediate panel 14c until their tabs 24 meet, the shelf unit 12 then being in a second intermediate depth position. Further extension of the front panel 14a pulls the second intermediate panel 14c over the rear panel 14d until their tabs 24 engage. Since the rear panel 14d is fixed, further forward movement of the panels 14 is prevented and the shelf unit 12 has a maximum depth.

A cable and sheave arrangement is provided to hold the front panel 14a, and accordingly all of the panels 14, perpendicular to the frame members 20. It enables the front panel 14a to be grasped at one end and pulled out without becoming twisted relative to the frame members 20 and other panels 14b–14d. Accordingly, binding between the shelf panels 14, which could make the shelf unit 12 inoperative, is prevented.

For each shelf unit 12, six ball bearing sheaves 28 are fixed to the frame members 20. Each frame member 20 has a front sheave 28a with a horizontal axis secured to the front of its flange portion 20'. A pair of vertically spaced rear sheaves 28b with vertical axes is also secured to the rear end of each frame member 20. The upper and lower rear sheaves 28b on each side are aligned with the top and bottom respectively of the associated front sheave 28a.

A single cable 30 is looped around the sheaves 28 as shown in the Figures with the loop being crossed at the rear (FIG. 5). The cable 30 is attached at its ends 31 to a turnbuckle 32 which may be tightened to tension the loop. Clips 34 are secured to the end flanges 19 of the front panel 14a by suitable means such as welding. The clips 34 are fixed to the cable 30 at the top of the loop, as by a U-bolt 36 as shown in FIG. 2.

Although it is preferred that the cable loop be crossed as shown, it need not be. The same operation is provided where the loop is not crossed by fixing one clip 34 to the cable 30 at the top of the loop and the other clip 34 to the cable 30 at the bottom of the loop. The latter clip 34 must extend down further than the clips 34 shown in the Figures.

The arrangement of the looped cable 30 is such that the portions of the cable 30 which are secured to the clips 34 travel together. Thus, if one end of the front panel 14a is pulled forward (or, alternatively, pushed back) one inch, the cable 30 will pull (push) the other side of the front panel 14a forward (back) one inch as well, thereby maintaining it in proper alignment with respect to the frame members 20 and the remaining panels 14.

The foregoing detailed description is given for clearness of understanding only, and no unnecessary limitations are to be understood therefrom, as modifications within the scope of the invention will be obvious to those skilled in the art.

I claim:

1. A shelf unit comprising:

two laterally spaced forwardly extending support members;

a rear panel extending between and supported at its ends on said support members;

at least one intermediate panel and a front panel, said intermediate panel being slidable over said rear panel and said front panel being slidable over said intermediate panel;

downwardly extending flanges on the ends of each of said panels;

tabs on the rear inner surface of said flanges of said intermediate and front panels;

tabs on the front outer surface of said flanges of said intermediate and rear panels;

whereby said inner tabs engage said outer tabs to limit the forward extension of said front panel with respect to said intermediate panel and of said intermediate panel with respect to said rear panel.

2. The shelf unit of claim 1 wherein each of said support members has a sheave fixed at the front end and two sheaves fixed at the rear end; and further comprising a looped cable extending around said sheaves, said loop extending forwardly along both of said support members and extending transversely between said rear sheaves; and means for securing both sides of said front panel to said cable whereby said cable maintains said front panel substantially perpendicular to said support members.

3. A shelf unit for a storage rack comprising:

two laterally spaced forwardly extending support members, each of said support members having a sheave fixed at the front end thereof and two spaced sheaves fixed at the rear end thereof;

a rear panel supported at its ends on said support members;

a front panel slidable over said rear shelf panel and having a transversely extending rear lip;

a looped cable extending around said sheaves, said loop extending forwardly along both of said support members and extending laterally between said rear sheaves; and means for securing both ends of said front panel to said cable whereby said cable maintains said front panel substantially perpendicular to said support members.

4. The shelf unit of claim 3, wherein the portion of said looped cable extending between said rear sheaves is crossed.

5. The shelf unit of claim 3, further comprising:

an intermediate panel having a transversely extending rear lip, said intermediate panel being slidable over said rear panel and said front panel being slidable over said intermediate panel;

downwardly extending flanges on the sides of each of said panels;

tabs on the rear inner surface of said flanges of said intermediate and front panels;

tabs on the front outer surface of said flanges of said intermediate and rear panels;

whereby said inner tabs engage said outer tabs to limit the forward extension of said front panel with respect to said intermediate panel and of said intermediate panel with respect to said rear panel.

6. The shelf unit of claim 5, further comprising indentations across the front edge of said rear and intermediate panels, said indentations being equal to the thickness of the lips on said intermediate and front panels, respectively.

7. A storage rack having vertical supports supporting a plurality of vertically spaced shelves at least one of said shelves other than the bottom shelf being adjustable and comprising:

two laterally spaced forwardly extending support members fixed to said vertical supports;

two sheaves fixed at the forward ends of the respective support members, each of said support members also having a pair of sheaves fixed at the rear ends;

a rear shelf panel extending between and supported at its ends on said support members;

a front panel slidable over said rear panel;

a looped cable extending around said sheaves, said loop extending along both of said support members and extending transversely between said rear sheaves; and means for securing both sides of said front panel to said cable whereby said cable maintains said front panel substantially perpendicular to said support members.

8. The storage rack of claim 7 wherein said adjustable shelves further comprise at least one intermediate panel, said intermediate panel being slidable over said rear panel and said front panel being slidable over said intermediate panel.

9. The storage rack of claim 8 wherein said adjustable shelves further comprise:

downwardly extending flanges on the ends of each of said panels;

tabs on the rear inner surface of said flanges of said intermediate and front panels;

tabs on the front outer surface of said flanges of said intermediate and rear panels;

whereby said inner tabs engage said outer tabs to limit the forward extension of said front panel with respect to said intermediate panel and of said intermediate panel with respect to said rear panel.

10. A shelf unit comprising:

two laterally spaced forwardly extending support members;

a rear panel extending between and supported at its ends on said support members;

first and second intermediate panels, said first intermediate panel being slidable over said second intermediate panel and said second intermediate panel being slidable over said rear panel;

a front panel slidable over said first intermediate panel;

downwardly extending flanges on the ends of each of said panels;

tabs on the rear inner surface of said flanges of said intermediate and front panels;

tabs on the front outer surface of said flanges of said intermediate and rear panels;

whereby said inner tabs engage said outer tabs to limit the forward extension of said front panel with respect to said intermediate panel and of said intermediate panel with respect to said rear panel.

11. The shelf unit of claim 10, further comprising:

a sheave fixed at the front end of each of said support members;

a pair of sheaves fixed at the rear end of each of said support members;

a looped cable extending around said sheaves, said loop extending along both of said support members and extending transversely between said rear sheaves; and means for securing both sides of said front panel to said cable whereby said cable maintains said front panel substantially perpendicular to said support members.

12. The shelf unit of claim 2, wherein said front sheaves have substantially horizontal axes and said rear sheaves have substantially vertical axes.

13. The shelf unit of claim 3, wherein said front sheaves have substantially horizontal axes and said rear sheaves have substantially vertical axes.

14. The storage rack of claim 7, wherein said front sheaves have substantially horizontal axes and said rear sheaves have substantially vertical axes.

* * * * *